US009366405B2

(12) United States Patent
Barta et al.

(10) Patent No.: US 9,366,405 B2
(45) Date of Patent: Jun. 14, 2016

(54) HEADLAMP SYSTEM FOR MOTOR VEHICLES

(71) Applicant: Varroc Lighting Systems, s.r.o., Senov u Noveho Jicina (CZ)

(72) Inventors: Ondrej Barta, Ostrava-Zabreh (CZ); Radek Chmela, Slavicin (CZ); Tomas Kreml, Ostrava-Poruba (CZ); Petr Straka, Babice (CZ)

(73) Assignee: VARROC LIGHTING SYSTEMS, S.R.O. (CZ)

( * ) Notice: Subject to any disclaimer, the term of this patent is extended or adjusted under 35 U.S.C. 154(b) by 82 days.

(21) Appl. No.: 14/294,275

(22) Filed: Jun. 3, 2014

(65) Prior Publication Data

US 2015/0146446 A1 May 28, 2015

(30) Foreign Application Priority Data

Nov. 22, 2013 (CZ) ..... PV 2013-925

(51) Int. Cl.
*F21V 7/00* (2006.01)
*F21S 8/10* (2006.01)

(52) U.S. Cl.
CPC ..... *F21S 48/1159* (2013.01); *F21S 48/1258* (2013.01); *F21S 48/1275* (2013.01); *F21S 48/1388* (2013.01); *F21S 48/1747* (2013.01); *F21S 48/1778* (2013.01); *F21S 48/328* (2013.01)

(58) Field of Classification Search
CPC ..... F21S 48/1159; F21S 48/1258; F21S 48/1275; F21S 48/1388; F21S 48/1747; F21S 48/1778; F21S 48/328
USPC ..... 362/516
See application file for complete search history.

(56) References Cited

U.S. PATENT DOCUMENTS

2005/0068787 A1 3/2005 Ishida
2006/0239021 A1 10/2006 Inaba
2007/0035961 A1* 2/2007 Stefka ..... F21S 48/10 362/538

(Continued)

FOREIGN PATENT DOCUMENTS

CZ 302002 B6 9/2010
CZ 200500005082005 B6 9/2010

(Continued)

OTHER PUBLICATIONS

Czech Republic Search Report for Application No. PV 2013-925 dated Aug. 26, 2014.

*Primary Examiner* — Bao Q Truong
*Assistant Examiner* — Hana Featherly
(74) *Attorney, Agent, or Firm* — Cantor Colburn LLP

(57) ABSTRACT

A projector headlamp includes light sources, a cooling system and reflector comprising an upper part with a first focal point and second focal point and a lower part with a first focal point and second focal point. The headlamp also includes an aperture with a cutoff edge proximate an optical axis of the headlamp and a convergent lens. The convergent lens includes at least two segments with their own first focal points, the first segment in a lower part of the convergent lens has a greater optical power than a second segment in an upper part, the first focal points of the segments located near the optical axis of the headlamp between the light sources and the lens. The light sources comprise at least two light sources, a first adjoins the first focal point of the upper part and a second adjoins the first focal point of the bottom part.

14 Claims, 2 Drawing Sheets

(56) References Cited

U.S. PATENT DOCUMENTS

| | | | |
|---|---|---|---|
| 2007/0086202 | A1 | 4/2007 | Tsukamoto et al. |
| 2011/0292669 | A1 | 12/2011 | Albou et al. |
| 2012/0039083 | A1 | 2/2012 | Meyrenaud |

FOREIGN PATENT DOCUMENTS

| | | | |
|---|---|---|---|
| EP | 1500869 | A1 | 1/2005 |
| WO | 2013120121 | A1 | 8/2013 |

* cited by examiner

HEADLAMP SYSTEM FOR MOTOR VEHICLES

CROSS-REFERENCES TO RELATED APPLICATIONS

This patent application claims priority to Czech Republic Patent Application Serial No. PV 2013925 filed on Nov. 22, 2013, which is incorporated herein by reference in its entirety.

BACKGROUND OF THE INVENTION

The invention concerns a headlamp for motor vehicles which is equipped with a projector system adapted to produce light patterns for both dimmed or front fog light beam and for main or DRL (Daytime Running Light) light beam, wherein high light intensities are ensured in the high or DRL light beam, low light intensities in the dimmed or front fog beam, and a homogeneous distribution of luminous intensity in the high or DRL beam without influencing a fixed aperture image.

At present headlamp systems exist that are equipped with a projector imaging system, which produces two lighting functions in the headlamp, namely, a generally dimmed and a high beam.

The existing projector systems are equipped with a light source, or optionally a cooling system for a light source, a reflector, an aperture and a converging lens. For example, in document CZ302002 is described a headlamp system consisting of a light source, a reflector which reflects the light emitted by the light source, an aperture and a converging lens situated in the reflected in the reflected light beam. A light pattern of specific form is achieved by means of a movable aperture, which is situated between the light source and the converging lens and which can be switched between two extreme positions: dimmed/high beam. However, this movable aperture in the first position shades some of the light reflected by the reflector, which produces a light/dark boundary for the emerging light beam, and in the second position it shades much less of the reflected light as compared to the first position but the light must go from the reflector past the aperture and produce the high beam after passing through the converging lens. The converging lens itself is fashioned as a bifocal lens and is composed of two segments, the first segment having a higher optical power than the second segment, while the first focal point of the first segment and the first focal point of the second segment are situated near the optical axis of the headlamp system between the light source and the converging lens, while the second focal point is situated closer to the converging lens than the first focal point. The light beam emerging from the light source is focused by means of the upper part of the reflector in the space of the first focal point of the first segment of the converging lens, while the lower part of the reflector focuses the light beam in the space of the first focal point of the second segment of the converging lens.

The drawback of this design is the fact that the light is emitted from one spot and this only by one light source, which does not enable the use of multiple light sources that are situated in different parts of the projector system according to the required parameters for the photometry of the emerging beam. Moreover, the solution according to document CZ302002 does not allow the use of an immovable fixed aperture for producing both types of beam, dimmed/far.

Designs of projector imaging systems are known from documents US20120039083A1 and US20110292669A1 that make it possible to realize a dimmed and a high beam, being outfitted with an immovable aperture, and the switching between the dimmed and the high beam is accomplished by the use of a separate system of at least two LED sources for the high beam. The light reflected from one reflector goes through the aperture and produces a dimmed pattern. For the use of the high beam, a further system of LED sources is activated, situated in another first focal point of a different part of the reflector. The light reflected from this part of the reflector again goes through the focal region of the single-focus lens, but now only partly passes by the aperture. The high beam can be realized either as an independent one, only activating one system of LED source and reflector, or as a so-called merged high beam, when both systems of LED source and reflector are active, and the high beam from the lower part of the reflector is added to the already existing dimmed beam.

The drawback to these solutions is the fact that they are equipped with a single-focus or monofocal converging lens, and a reflector system with a common second focal point, where both these focal points, the first focal point of the lens and the second focal point of the upper and lower parts of the reflector, are shared and lie in proximity to the clipping edge of the aperture on the optical axis of the headlamp system. As is evident, in the case of the merged high beam, the reflected light beam from the lower part of the reflector, in conjunction with the fixed aperture and the monofocal lens, will be more shaded by the aperture and thus the quantity of transmitted light will be less, and moreover the edge of the aperture (shadow of the clipping edge of the aperture) will be imaged in this high beam, which significantly degrades both the photometric efficiency and the resulting homogeneity of the high beam. The cited documents attempt to solve this problem by the use of several light sources, by reducing the thickness of the aperture in the area of the clipping edge (shape before the edge) or by complicated shapes of the clipping edge of the aperture, all with the goal of minimizing the influence of the imaging of the aperture in the high beam. The drawback is the demanding manufacture of the aperture and only partial elimination of the undesirable effect of the imaging.

The problem of the proposed invention is to present a new headlamp system for motor vehicles operating on the projection principle, where the light is emitted from at least two light sources passing through an optical system formed by a reflector with at least two parts having a separate position for their first and second focal points and a converging lens with at least two segments having their own first focal points, and producing a dimmed or a front fog beam and a high or DRL beam, while between these light beams there is achieved a sufficient separation of the light intensity, the resulting pattern of the merged high beam and the dimmed pattern is homogeneous, and the optical efficiency is a maximum in regard to the simplicity and low manufacturing costs of the other parts of this optical system.

SUMMARY OF THE INVENTION

In an exemplary embodiment, a projector headlamp is disclosed. The projector headlamp includes light sources and a cooling system. The projector headlamp also includes a reflector comprising an upper part with a first focal point and with a second focal point and a lower part with a first focal point and with a second focal point. The projector headlamp further includes an aperture arranged with its cutoff edge in proximity to an optical axis of the headlamp and a convergent lens. The convergent lens includes at least two segments with their own first focal points, wherein a first segment situated in a lower part of the convergent lens has a greater optical power than a second segment situated in an upper part of the convergent lens, and the first focal points of the individual segments of the convergent lens are located near the optical axis of the headlamp between the light sources and the convergent lens. The system of light sources comprises at least two light sources, where a first light source adjoins the first focal point of the upper part of the reflector and a second light source adjoins the first focal point of the bottom part of the reflector. The first focal point of the first segment of the convergent lens is adjacent to a cutoff edge of the aperture or aperture in a first position and the first focal point or points of the second or other segments of the convergent lens lie outside a region of the first focal point of the first segment behind and beneath the first focal point of the first segment of the convergent lens in the direction of the path of light rays from the reflector to the lens. The second focal point of the upper part of the reflector is adjacent to the first focal point of the first segment of the convergent lens and the second focal point of the bottom part of the reflector is adjacent to the first focal point-of the first segment or the first focal point of the second segment of the converging lens.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which specific sample embodiments of the invention are shown schematically, where:

Figure 1:
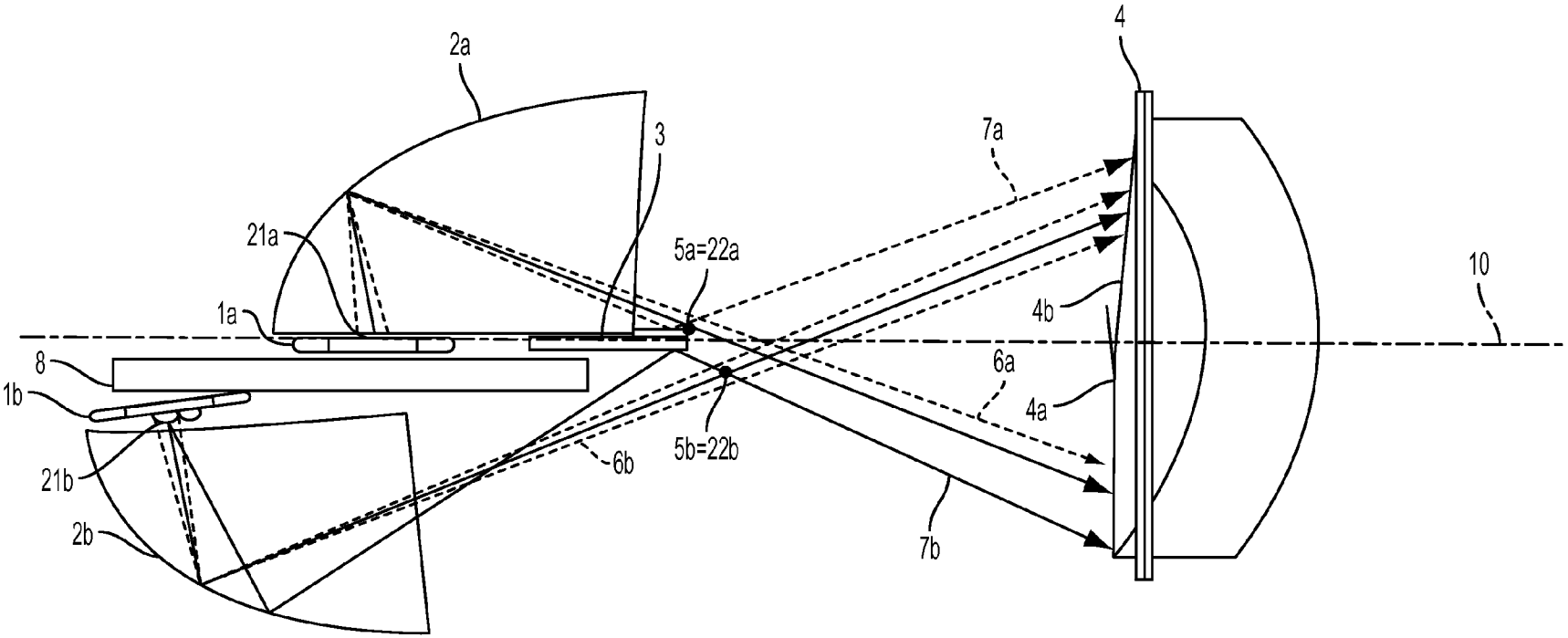
FIG. 1 is a longitudinal section through a projector imaging system with a fixed aperture.

The drawings which illustrate the proposed invention and the examples of a specific embodiment described afterwards in no case shall limit the extent of the protection indicated in the definition, but merely explain the foundations of the invention.

DETAILED DESCRIPTION OF THE INVENTION

The drawbacks of the prior art are eliminated and the problem of the invention is solved in the headlamp system according to the invention, composed of at least two light sources, a cooler, a reflector, an aperture and a lens. The reflector contains an upper and a lower part with their own first and second focal points in combination with a converging lens consisting of two or more segments with their own first focal points. The segment of the converging lens situated in the lower part has a greater optical power than the second or other segments situated in the upper part of the converging lens. The first focal point of the individual segments of the converging lens are located near the optical axis of the headlamp system between the light sources and the converging lens.

The first focal point of the first segment of the converging lens is adjacent to the cutoff edge of the aperture and the first focal point or points of the second or other segments of the converting lens lie outside the region of the first focal point of the first segment behind and beneath the first focal point of the first segment of the converging lens in the direction of the path of the rays from the reflector to the lens. The second focal point of the upper part of the reflector is adjacent to the first focal point of the first segment of the converging lens and the second focal point of the bottom part of the reflector is adjacent to the first focal point of the first segment or the first focal point of the second segment of the converging lens.

The headlamp contains at least two light sources, where one light source adjoins the first focal point of the upper part of the reflector and the second light source adjoins the first focal point of the bottom part of the reflector.

Advantageous embodiments of the invention are characterized by the features: the light sources are formed by at least one light-emitting element. The upper and lower part of the reflector is formed by several reflector segments and is separated by the body of the cooler of the light sources. The front side and/or the rear side of the converging lens is composed of two or more segments with different optical power and different focal points and it is described by an analytical function or it has a spherical or general profile. The overall external form of the converging lens is planoconvex or biconvex or concavoconvex and its aperture has a circular or generally some other stylistic shape. The exit side of the converging lens has a controlled microtexture to produce an optimal interface gradient in the dimmed and/or front fog light beam.

Between the converging lens and the reflector is an immovable or movable aperture, whose cutoff edge is situated near the first focal point of the lens and thus thanks to the shape of its edge produces a light beam with a boundary of dimmed light or front fog light. The immovable aperture has an absorptive or mirror metallization and thus reflects the originally wide-aperture light on the entry aperture of the converging lens. The movable aperture has a flat or three-dimensional shape. The immovable aperture and the movable aperture have a three-dimensional capability of adjusting their nominal position with respect to the other parts of the projector system.

The converging lens, the reflectors or the body of the cooler further contains at least one optical element creating a lighting of a vertical road sign above the roadway and/or they light up other desired areas of the roadway space.

The benefits of the headlamp according to the invention are that a sufficient separation of the light intensity is achieved between the dimmed or a front fog beam and a the high or DRL beam, the resulting pattern of the merged high beam and the dimmed pattern is homogeneous, the intensity of the high or DRL beam is higher as compared to the prior art, and the effectiveness of the headlamp is greater in relation to the manufacturing costs.

Referring now to the Figures, where the invention will be described with reference to specific embodiments, without limiting same, FIG. 1 shows a headlamp system in accordance with the invention. The headlamp system comprises a primary light source 1*a*, located at the first focal point 21*a* of an upper reflector 2*a*, which implements the dimmed beam, a secondary light source 1*b*, located at the first focal point 21*b* of a lower reflector 2*b*, which implements the independent high beam. The path of rays of reflected light by the reflectors in the forward direction is indicated by the arrows 6*a*, 6*b*. The headlamp system per FIG. 1 further comprises a convergent bifocal, biconvex lens 4, which is located in the direction of the reflected light 6*a*, 6*b* along the optical axis 10 of the projector headlamp system. In front of the convergent lens 4 is located a fixed aperture 3, whose cutoff edge creates the shape of the dimmed beam.

The convergent lens 4 consists of a first segment 4*a* and a second segment 4*b*, which have different optical power. The optically more powerful segment has a generally more convex profile, i.e., the profile has a greater bulging than the optically less powerful segment. The upper segment 4*b* of the convergent lens has a first focal point 5*b* and the lower segment 4*a* has a first focal point 5*a*. The first focal points 5*a*, 5*b* of the convergent lens 4 lie at the spot of the second focal points 22*a*, 22*b* of the reflector system 2*a*, 2*b*.

Since the convergent lens 4 is divided into two segments by the horizontal plane, the first segment 4*a* forms the lower part of the convergent lens 4 and the second segment 4*b* forms the upper part of the convergent lens 4. In the event that the exit aperture of the convergent lens 4 has the same optical diameter of the upper and lower part, a step will be produced at the site of the separation. If the upper and lower part of the convergent lens 4 are continuously joined at the vertex of the convergent lens 4, the optical diameter of the exit aperture of the upper and lower part of the convergent lens 4 will differ. The light 3*a* from the light source 1*a* is reflected by the upper reflector 2*a* predominantly onto the first segment 4*a* of the convergent lens 4. Thus, the edge of the aperture 3 in proximity to the first focal point 5*a* of the first segment 4*a* of the convergent lens 4 will create the boundary of the dimmed beam. The light 6*b* from the light source 1*b* reflected by the lower reflector 2*b* will impinge with a lesser portion on the aperture 3, but predominantly pass by this aperture through the first focal point 5*b* of the second segment 4*b* of the convergent lens 4 and fill this upper segment 4*b* of the convergent lens. Thus, the unwanted influence of the imaging of the fixed aperture 3 in the high beam pattern is minimized and the final pattern of the merged high beam (superpositioning of the dimmed and the high beam, both LED sources 1*a* and 1*b* are turned on) is homogeneous with no contrast transition.

Increased optical efficiency is possible by having a mirror metallization of the fixed aperture 3. The aperture 3 then reflects onto the lens 4 also the rays 7*a*, 7*b* normally terminating on the aperture (in the case of an absorptive coating) and these can also be imaged by the lens 4 in the final light pattern and increase its efficiency.

Figure 2:
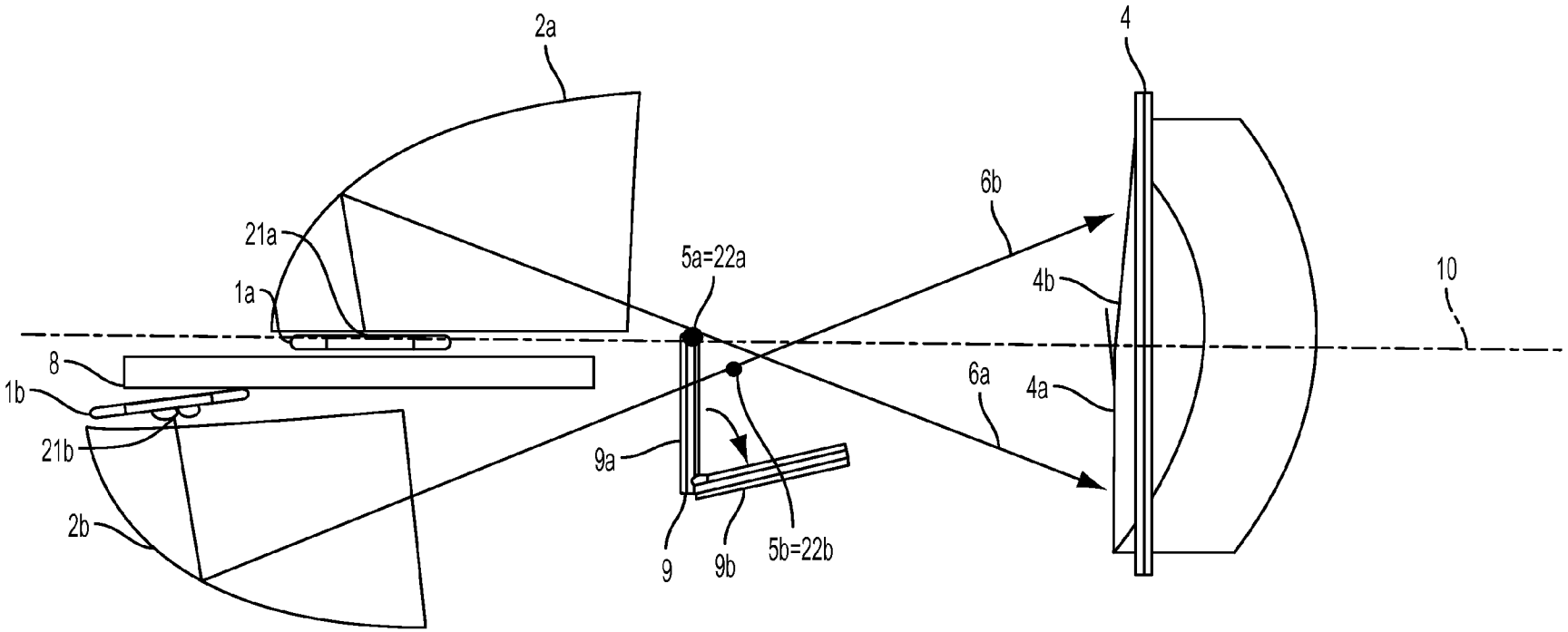
FIG. 2 is a longitudinal section through a projector imaging system with a movable aperture.

FIG. 2 shows another sample embodiment of a headlamp system according to the invention. The headlamp system comprises an LED light source 1*a*, located at the first focal point 21*a* of an upper reflector 2*a* for the dimmed beam, an LED light source 1*b* located at the first focal point 21*b* of a lower reflector 2*b* for the high beam. The path of rays of reflected light by the reflectors in the forward direction is indicated by the arrows 6*a*, 6*b*. The headlamp system per FIG. 2 further comprises a convergent bifocal, biconvex lens 4, which is located in the direction of the reflected light 6*a*, 6*b* along the optical axis 10 of the projector headlamp system. In front of the convergent lens 4 is located a movable aperture 9, whose cutoff edge creates the dimmed beam pattern.

The convergent lens 4 consists of a first segment 4*a* and a second segment 4*b*, which have different optical power. The optically more powerful segment has a generally more convex profile, i.e., the profile has a greater bulging than the optically less powerful segment. The upper segment 4*b* of the convergent lens has a first focal point 5*b* and the lower segment 4*a* has a first focal point 5*a*. The first focal points 5*a*, 5*b* of the convergent lens 4 lie at the spot of the second focal points 22*a*, 22*b* of the reflector system 2*a*, 2*b*.

Since the convergent lens 4 is divided into two segments by the horizontal plane, the first segment 4*a* forms the lower part of the convergent lens 4 and the second segment 4*b* forms the upper part of the convergent lens 4. In the event that the exit aperture of the convergent lens 4 has the same optical diameter of the upper and lower part, a step will be produced at the site of the separation. If the upper and lower part of the convergent lens 4 are continuously joined at the vertex of the convergent lens 4, the optical diameter of the exit aperture of the upper and lower part of the convergent lens 4 will differ.

If the movable aperture 9 is in the first position 9*a*, the light 6*a* from the LED light source 1*a* is reflected by the upper reflector 2*a* predominantly onto the first segment 4*a* of the convergent lens 4. The edge of the aperture 9 in position 9*a* is in proximity to the first focal point 5*a* of the first segment 4*a* of the convergent lens 4 and thus will create the boundary of the dimmed beam. The light 6*b* from the LED light source 1*b* reflected by the lower reflector 2*b* will impinge in part on the aperture 9 in position 9*a* and in part on the second segment 4*b* of the convergent lens 4, passing above the focal point 5*b*, and therefore it is directed toward the region below the horizontal and does not contribute to unwanted luminous intensity in proximity to the boundary of the dimmed beam and the horizon. If the movable aperture 9 is in the second position 9*b*, the light 6*a* from the LED light source 1*a* is reflected by the upper reflector 2*a* predominantly onto the first segment 4*a* of the convergent lens 4, passes through the region of the focal point 5*a* and participates in the high beam. The light 6*b* from the LED light source 1*b* reflected by the lower reflector 2*b* passes through the region of the focal point 5*b* and also participates in the final high beam.

The aperture 9 can be mounted rotationally from the first vertical position to the second horizontal position, while in the first vertical position of the aperture 9 the cutoff edge of the aperture 9 lies perpendicular to the axis of the headlamp and the aperture 9 predominantly shades the path of the light beam from the lower reflector part 2*b* and in the second horizontal position the aperture 9 predominantly clears the path of the light beam from the lower reflector part 2*a* to the second segment 4*b* of the convergent lens 4.

The headlamp system per FIG. 2 also makes it possible to achieve high light intensities in the region of the horizontal in the high beam, just as in the projector systems known thus far. However, when the aperture 9 is switched to position 9*a* for the dimmed beam the light reflected by the lower reflector 2*b* is directed past the region in which low light intensity is desired and thus a greater difference in light intensities in the dimmed and the high beam is achieved.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

The invention claimed is:

1. A projector headlamp, comprising:

a system of light sources;

a cooling system;

a reflector comprising:

an upper part with a first focal point and with a second focal point, and a lower part with a first focal point and with a second focal point;

an aperture arranged with its cutoff edge in proximity to an optical axis of the headlamp; and a convergent lens comprising at least two segments with their own first focal points, wherein a first segment situated in a lower part of the convergent lens has a greater optical power than a second segment situated in an upper part of the convergent lens, and the first focal points of the individual segments of the convergent lens are located near the optical axis of the headlamp between the light sources and the convergent lens, wherein the system of light sources comprises at least two light sources, where a first light source adjoins the first focal point of the upper part of the reflector and a second light source adjoins the first focal point of the bottom part of the reflector, and also the first focal point of the first segment of the convergent lens is adjacent to a cutoff edge of the aperture or aperture in a first position and the first focal point or points of the second or other segments of the convergent lens lie outside a region of the first focal point of the first segment behind and beneath the first focal point of the first segment of the convergent lens in the direction of the path of light rays from the reflector to the lens, and the second focal point of the upper part of the reflector is adjacent to the first focal point of the first segment of the convergent lens and the second focal point of the bottom part of the reflector is adjacent to the first focal point of the first segment or the first focal point of the second segment of the converging lens.

2. The headlamp according to claim 1, wherein the first light source or the second light source comprise at least one light-emitting element.

3. The headlamp according to claim 1, wherein the upper part or the lower part of the reflector comprise at least one reflector segment.

4. The headlamp according to claim 1, wherein the upper part or the lower part of the reflector or the reflector segments or the light sources are separated by a body of a cooler of the light system.

5. The headlamp according to claim 1, wherein a front side or a rear side of the convergent lens comprises two or more segments, each with a different optical power and different first focal points.

6. The headlamp according to claim 1, wherein a front or a rear optical surface of the convergent lens is described by an analytical function or has a spherical or general profile.

7. The headlamp according to claim 1, wherein an overall external form of the convergent lens is planoconvex, biconvex or concavoconvex.

8. The headlamp according to claim 1, wherein the aperture of the convergent lens has a circular or non-circular stylistic shape.

9. The headlamp according to claim 1, wherein the exit side of the convergent lens has a controlled microtexture.

10. The headlamp according to claim 1, wherein the aperture is movable or immovable nature in implementing lighting functions.

11. The headlamp according to claim 1, wherein the movable aperture has a flat or three-dimensional shape.

12. The headlamp according to claim 1, wherein the aperture has a three-dimensional capability of adjusting a nominal position with respect to other parts of the projector headlamp.

13. The headlamp according to claim 1, wherein the immovable or movable aperture has at least a partly absorptive or partly mirror metallization.

14. The headlamp according to claim 1, wherein the convergent lens or the upper part of the reflector or the lower part of the reflector and/or the body of the cooler contain at least one other optical element for lighting of a vertical road or for lighting other desired areas of the roadway space.

* * * * *